US006695610B2

(12) United States Patent
Tsang

(10) Patent No.: US 6,695,610 B2
(45) Date of Patent: Feb. 24, 2004

(54) LIGHTER

(75) Inventor: Kelvin Chiu Yuet Tsang, Hong Kong (HK)

(73) Assignee: Trend & Aim International Limited (HK)

( * ) Notice: Subject to any disclaimer, the term of this patent is extended or adjusted under 35 U.S.C. 154(b) by 54 days.

(21) Appl. No.: 09/842,290

(22) Filed: Apr. 25, 2001

(65) Prior Publication Data

US 2002/0160328 A1 Oct. 31, 2002

(51) Int. Cl.[7] ..... F23Q 2/16
(52) U.S. Cl. ..... 431/153; 431/276; 431/277
(58) Field of Search ..... 431/153, 276, 431/277

(56) References Cited

U.S. PATENT DOCUMENTS 4,717,335 A * 1/1988 Loveless ..... 431/153
5,460,516 A * 10/1995 Sher ..... 431/153
5,597,299 A * 1/1997 Jon ..... 431/153
5,655,902 A * 8/1997 Doucet ..... 431/153
5,743,725 A * 4/1998 Chan ..... 431/153

* cited by examiner

*Primary Examiner*—Henry Bennett
*Assistant Examiner*—James G. Barrow
(74) *Attorney, Agent, or Firm*—F. Chau & Associates, LLP

(57) ABSTRACT

The present invention involves a lighter for preventing unintended use. In one aspect, a striker wheel including a rotation limiting means is provided, where an arc formed by the rotation limiting means is preferably greater than about 100° and less than or equal to about 220°. The rotation limiting means may comprise a single or multiple protrusions, a shield extending from one or more outer grip wheels, or a cover attached to a periphery of the striking wheel.

13 Claims, 6 Drawing Sheets

LIGHTER

BACKGROUND OF THE INVENTION

1. Technical Field

The present invention relates generally to a lighter, and more particularly, to a spark ignition lighter for preventing unintended lighting of a flame and a method for using same.

2. Description of Related Art

A typical gas lighter 1, as shown in FIG. 1, comprises a housing 2 into which flammable material is held. A flint 3 is mounted in a depression 4 and is supported by a compression spring 5. A gas nozzle 6 receives flammable material from within the housing 2. A valve 9 is provided for controlling the release of the flammable material from the housing. The valve can be opened by downward pressure on a gas lever 7, which pushes up an en 8 to lift a nozzle 6 to open the valve 9.

The gas lever 7 is preferably operated in conjunction with a spark producing mechanism so that the flow of flammable material (fuel) is ignited soon after it commences. For example, lighters employing conventional spark wheels require a user to rotate a toothed spark wheel against a flint in order to generate a spark. The user then depresses the gas lever to release gas and produce a flame. To illustrate, a striker wheel 10 is provided which preferably includes a pair of side grip wheels 13 to rotate a central wheel 11 which has a roughened peripheral surface 12 for frictionally engaging with the flint 3 to cause sparks.

Although lighters of this type can produce a flame with a minimal amount of difficulty, such ease of operation can also result in a potentially hazardous situation due to unintentional operation, for example, if such a lighter is left unattended within reach of a child.

Accordingly, there is a need for a lighter which reduces the chances of unintentional operation in a simple and effective way, while at the same time maintaining its user-friendliness for intended users.

SUMMARY OF THE INVENTION

The present invention relates to a lighter resistant to unintentional operation, wherein the lighter employs a system and method which presents increased difficulty of operation by unintended users, and more particularly, relates to a spark ignition lighter with such a system.

In one aspect of the present invention, a lighter is provided comprising a gas reservoir; a gas nozzle; means to cause gas to be supplied from the reservoir to the gas nozzle; a flint; a striker wheel rotatable to frictionally engage the flint to generate sparks for igniting gas emitted at the gas nozzle, said striker wheel including a pair of attached outer grip wheels for rotation of the striker wheel by a user; and a rotation limiting means for limiting rotation of the striker wheel.

In another aspect of the present invention, a striker wheel unit is provided comprising a striker wheel rotatable to frictionally engage a flint to generate sparks for igniting gas emitted at a gas nozzle; and a rotation limiting means for limiting rotation of the striker wheel.

These, and other aspects, features and advantages of the present invention will be described or become apparent from the following detailed description of the preferred embodiments, which is to be read in connection with the accompanying drawings.

DETAILED DESCRIPTION OF PREFERRED EMBODIMENTS

With reference now to the drawings, a new and improved lighter embodying the principles of the present invention will be described.

Figure 1:
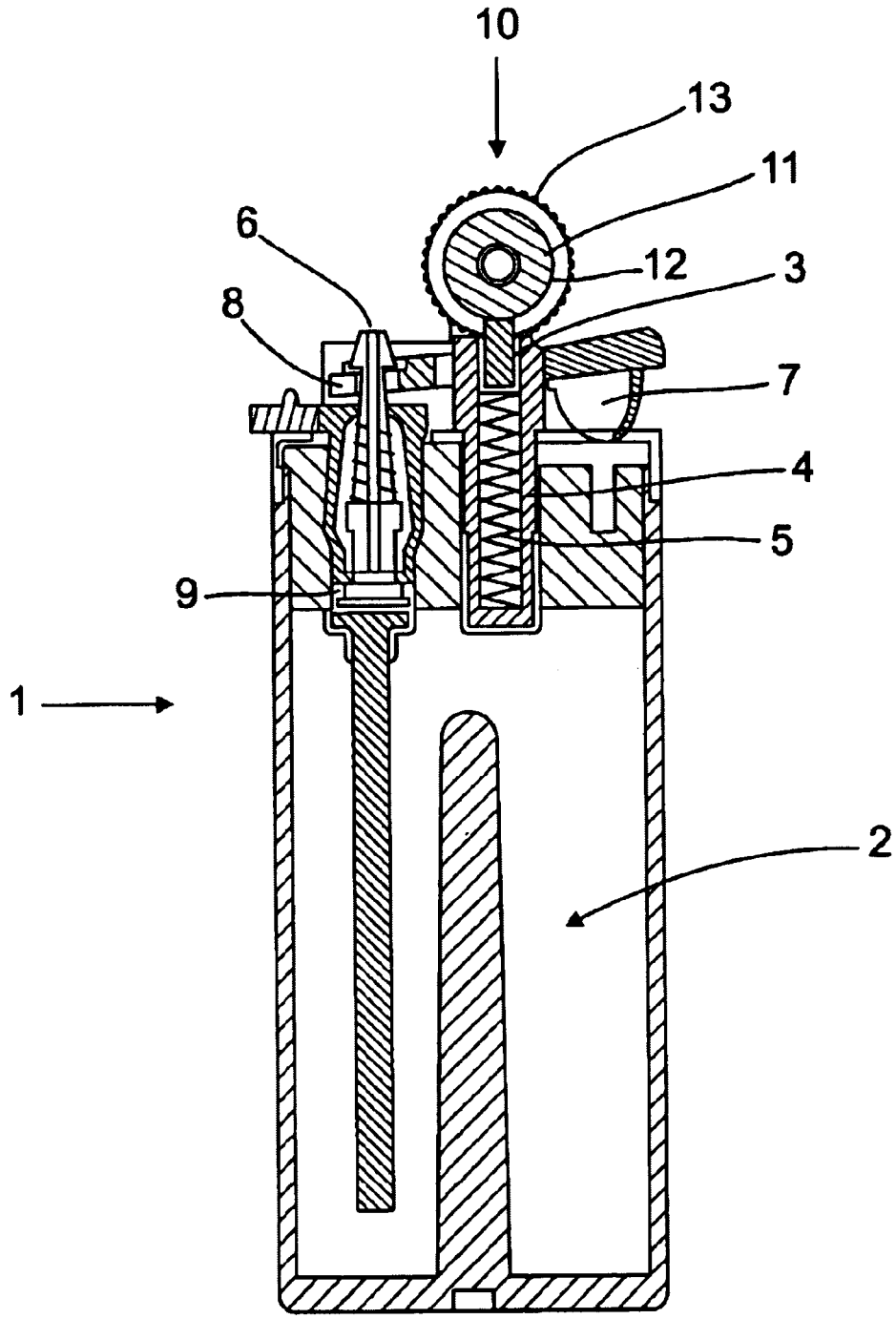
FIG. 1 is an exemplary illustration of a typical gas lighter comprising a housing into which flammable material is held.
Figure 2:
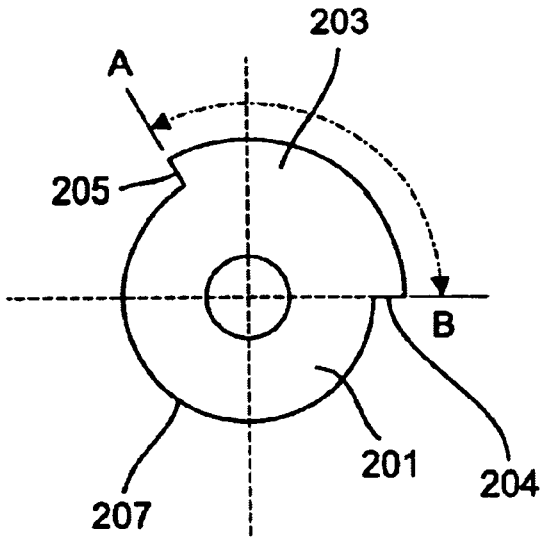
FIG. 2 depicts an exemplary central striker wheel according to an aspect of the present invention.

FIG. 2 depicts an exemplary central striker wheel 201 according to an aspect of the present invention. The striker wheel 201 includes a protruded area 203 which extends over a selected arc of the circumference of the striker wheel 201. As a result, when the striker wheel 201 is rotated, an end surface 204 or 205 of the protruded area 203 will abut against the flint 3 or material surrounding the depression 4, thus substantially preventing further rotation.

Generally, to successfully produce a flame from a spark ignition lighter, the striker wheel unit 10 must be rotated a minimum of about 120°. An arc of the periphery 207 which is blocked by the flint 3 of the depression 4 in which the spring 5 is positioned can comprise for example, about 20° to about 50°. To ensure that a second ignition cannot result from rotating the striker wheel, in a preferred embodiment the protruded area 203 preferably creates an arc in which the angle A to B is greater than about 100°.

Thus, a minimum allowed rotation of the striker wheel is, for example, about 140°, and a maximum allowed rotation is about 260°. In a preferred embodiment, the minimum rotation is between about 140° and about 170°, and a maximum rotation is between about 230° and less than about 260°.

Figure 3:
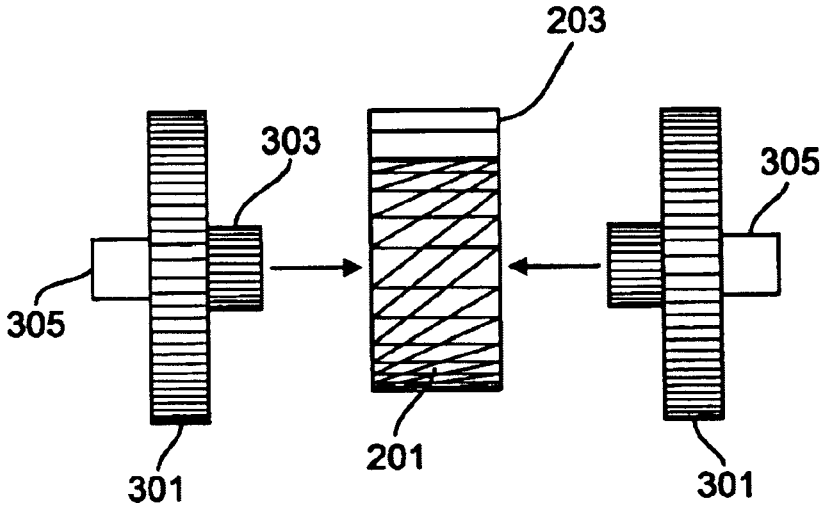
FIG. 3 depicts an exemplary front view of the striker wheel of FIG. 2 showing a protruded area.

FIG. 3 depicts an exemplary front view of the striker wheel of FIG. 2 showing the protruded area 203. Outer grip wheels 301 are attached to either side of the striker wheel 201. The engagement of the outer grip wheels 301 to the striker wheel may be, for example, by a central stub 303 being positioned in a suitable receiving depression or aperture located on an axis of the striker wheel 201. The outer grip wheels 301 are also provided with outer stubs 305 for engagement with the body of the lighter.

Figure 4:
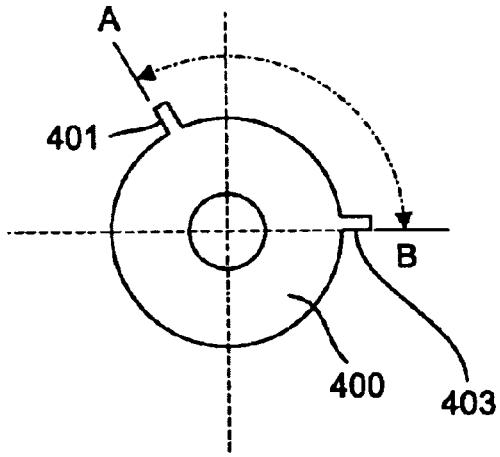
FIG. 4 depicts an exemplary striker wheel according to another embodiment of the present invention.

FIG. 4 depicts an exemplary striker wheel according to another embodiment of the present invention. The striker wheel 400 includes at least two protrusions 401 and 403 which abut from and limit the rotation of the striker wheel 400. An angle (A,B) formed by the protrusions is preferably greater than about 100°.

Figure 5:
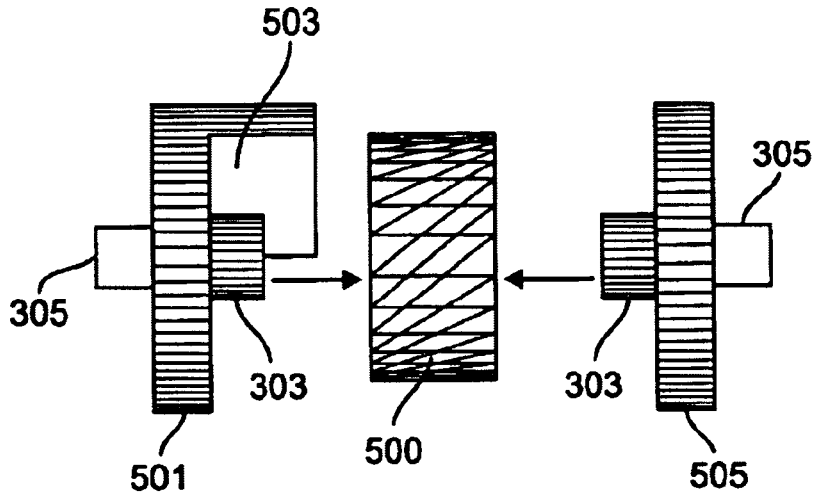
FIG. 5 depicts an exemplary striker wheel unit wherein at least one outer grip wheel includes a shield to limit the rotation of the striker wheel according to an embodiment of the present invention.

FIG. 5 depicts an exemplary striker wheel unit wherein at least one outer grip wheel includes a shield to limit the rotation of the striker wheel according to an embodiment of the present invention. At least one outer grip wheel 501 or 505 includes an attached shield 503 which extends over the striker wheel 500 when the striker wheel is engaged with both outer grip wheels 501 and 505. The arc formed by the shield is preferably of a length as described in relation to FIGS. 2 and 4; i.e., formed by an angle greater than about 100°.

Figure 6:
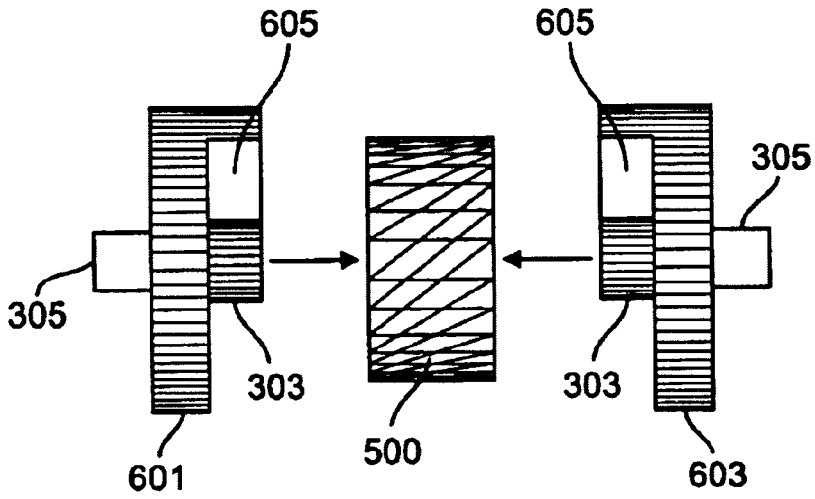
FIG. 6 depicts an exemplary striker wheel unit wherein both outer grip wheels include a shield to limit the rotation of the striker wheel according to an embodiment of the present invention.

FIG. 6 depicts an exemplary striker wheel unit wherein both outer grip wheels include a shield to limit the rotation of the striker wheel according to an embodiment of the present invention. Each outer grip wheel 601 and 603 includes a shield 605. Preferably, each shield 605 extends about halfway across the striker wheel 500 (although unequally sized shields can be provided) such that the striker wheel is at least partially covered. The arc formed by the shield is preferably of a length as described in relation to FIG. 5; i.e., formed by an angle greater than about 100°.

Figure 7:
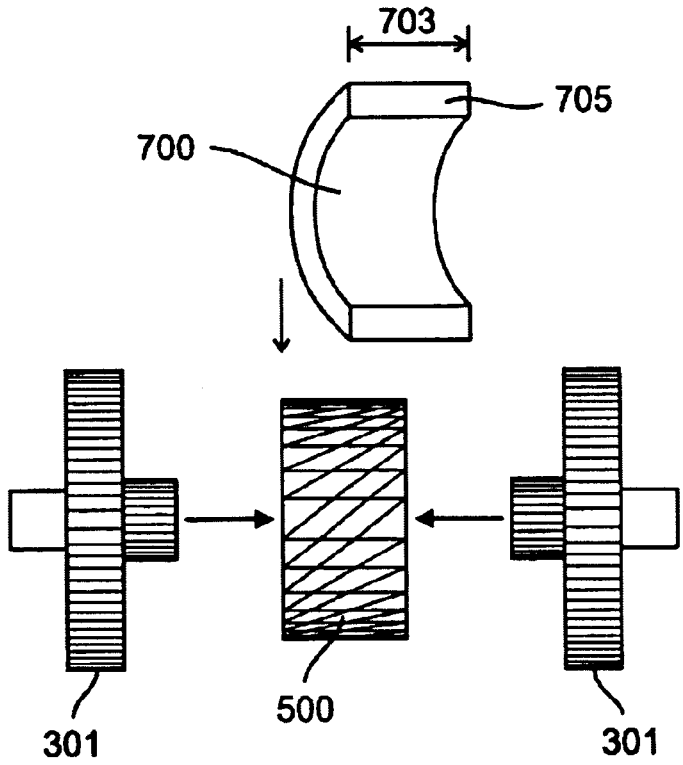
FIG. 7 depicts an exemplary striker wheel unit wherein the striker wheel includes a cover connected to its peripheral surface to limit the rotation of the striker wheel according to an embodiment of the present invention.

FIG. 7 depicts an exemplary striker wheel unit wherein the striker wheel includes a cover connected to its peripheral surface to limit the rotation of the striker wheel according to an embodiment of the present invention. The cover 700 is preferably of a width 703 that at least partially covers the width of the striker wheel 500, such that an end portion 705 will abut against the flint 3 or the material surrounding depression 4 substantially preventing further rotation. Again, the arc formed by the cover 700 is preferably of a length as described in FIG. 5, i.e., formed by an angle greater than about 100°.

Figure 8:
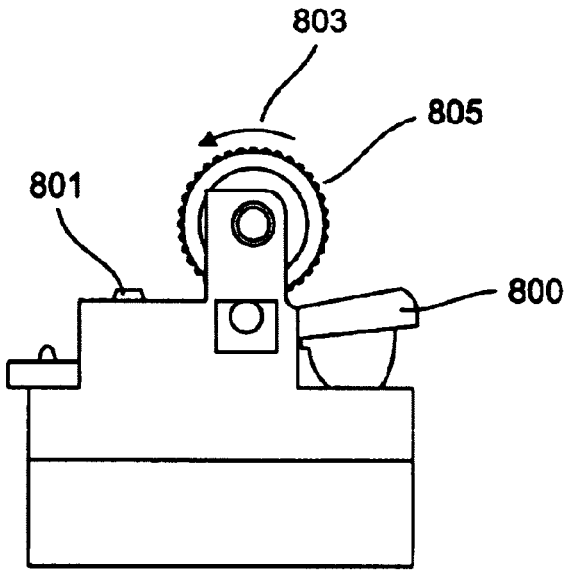
FIGS. 8 and 9 depict an exemplary method of producing a flame using a lighter according to an aspect of the present invention.
Figure 9:
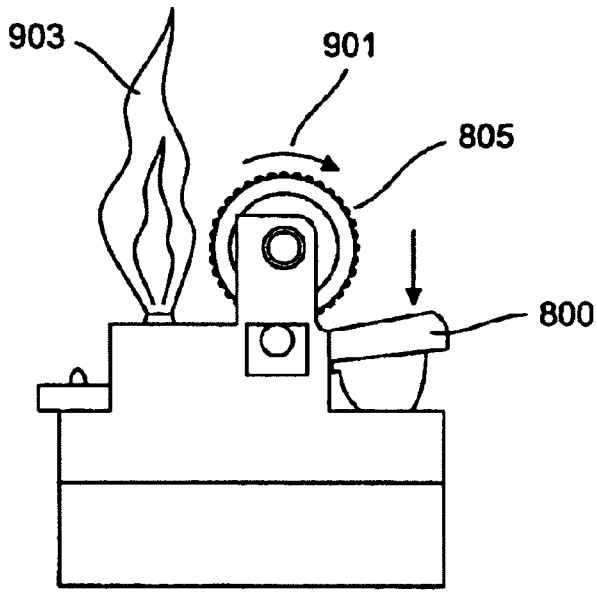

FIGS. 8 and 9 depict an exemplary method of producing a flame using a lighter according to an aspect of the present invention. In FIG. 8, initially, lever 800 is depressed to allow gas to escape from the nozzle 801. At the same time, modified striker wheel unit 805 which has been modified according to an aspect of the present invention is rotated in the direction of arrow 803 until the protruded area 203, the protrusions 401 and 403, the shields 503 or 605, or the cover 700 abuts the flint 3 or the surrounding area of the depression 4 into which the flint is placed. That is, the modified striker wheel is rotated until, for example, the end 205 (or its equivalent) strikes the flint 3 or the supporting structure thus preventing further rotation.

Once in this position, the modified striker unit is rotated in the direction of arrow 901 as depicted for example, in FIG. 9, thus allowing a flame 903 to be struck. Further rotation of the modified striker unit 805 (to strike a light again) is not possible until the modified striker unit is again rotated in the direction of arrow 803.

Thus, advantageously, a lighter according to an aspect of the present invention requires a preliminary rotation of the striker wheel (which is in a direction such that any sparks generated will be directed away from the gas nozzle) before another striking of the striker unit which is of sufficient rotation to generate a flame can be undertaken. Such a set of steps is difficult, for example, for a child to perform and also prevents unintentional lighting of a flame, thus resulting in an improvement in the safety of the lighter.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the present invention.

What is claimed is:

1. A lighter comprising:

a gas reservoir;

a gas nozzle;

means to cause gas to be supplied from the reservoir to the gas nozzle;

a flint;

a striker wheel rotatable to frictionally engage the flint to generate sparks for igniting gas emitted at the gas nozzle, said striker wheel including a pair of attached outer grip wheels for rotation of the striker wheel by a user; and a rotation limiting means for limiting rotation of the striker wheel, wherein the rotation limiting means comprises one or more protrusions on the striker wheel, and one protrusion is provided forming an arc covering at least 1000 of a periphery of the striking wheel.

2. The lighter of claim 1, wherein the rotation of the striker wheel is limited to a rotation of about 140° to about less than 260°.

3. The lighter of claim 1, wherein a flame is produced by rotating the striker wheel in a first direction until the rotation limiting means prevents any further rotation, and then rotating the striker wheel in a second opposing direction.

4. A lighter comprising:

a gas reservoir;

a gas nozzle;

means to cause gas to be supplied from the reservoir to the gas nozzle;

a flint;

a striker wheel rotatable to frictionally engage the flint to generate sparks for igniting gas emitted at the gas nozzle, said striker wheel including a pair of attached outer grip wheels for rotation of the striker wheel by a user; and a rotation limiting means for limiting rotation of the striker wheel, wherein the rotation limiting means comprises one or more protrusions on the striker wheel, and wherein two protrusions are provided spaced apart over at least 100° of a periphery of the striking wheel.

5. The lighter of any one of claim 1 or 4, wherein each protrusion includes at least one edge for abutting against one or more stops in the lighter to prevent a complete rotation of the striker wheel.

6. A striker wheel unit comprising:

a striker eel rotatable to frictionally engage a flint to generate sparks for igniting gas emitted at a gas nozzle; and a rotation limiting means for limiting rotation of the striker wheel, wherein th rotation limiting means comprises one or more protrusions on the striker wheel, and one protrusion is provided forming an arc covering at least 100° of a periphery of the striking wheel.

7. The striker wheel unit of claim 6, wherein the striker wheel rotates about 140° to about less than 260°.

8. The striker wheel unit of claim 6, wherein the striker wheel is positioned between a pair of outer grip wheels for allowing the user to rotate the striker wheel, the rotation limiting means comprising a shield attached to at least one of the outer grip wheels, each shield extending at least partially over the striker wheel.

9. The striker wheel unit of claim 6, wherein a flame is produced by rotating the striker wheel in a first direction until the rotation limiting means prevents any further rotation, and then rotating the striker wheel in a second opposing direction.

10. The striker wheel unit of claim 6, wherein each protrusion includes at least one edge for abutting against one or more stops in the lighter to prevent a complete rotation of the striker wheel.

11. A striker wheel unit comprising:

a striker wheel rotatable to frictionally engage a flint to generate sparks for igniting gas emitted at a gas nozzle; and a rotation limiting means for limiting rotation of the striker wheel, wherein the rotation limiting means comprises one or more protrusions on the striker wheel and two protrusions are provided spaced apart over at least 100° of a periphery of the striking wheel.

12. A lighter comprising:

a gas reservoir;

a gas nozzle, means to cause gas to be supplied from the reservoir to the gas nozzle;

a flint;

a striker heel rotatable to frictionally engage the flint to generate sparks for igniting gas emitted at the gas nozzle, said striker wheel including a pair of attached outer grip wheels for rotation of the striker wheel by a user; and a rotation limiting means for limiting rotation of the striker wheel, wherein the rotation limiting means comprises a cover attached to the strike wheel and a shield attached to at least one of the outer grip wheels, the shield extending at least partially over the striker wheel.

13. A lighter comprising:

a gas reservoir;

a gas nozzle;

means to cause gas to be supplied from the reservoir to the gas nozzle;

a flint;

a striker wheel rotatable to frictionally engage the flint to generate sparks or igniting gas emitted at the gas nozzle, said striker wheel including a pair of attached outer grip wheels for rotation of the striker wheel by a user; and a rotation limiting means for limiting rotation of the striker wheel, wherein the rotation limiting means comprises a cover attached to a peripheral surface of the striker wheel, the cover forming an arc covering at least 100° of a periphery of the striking wheel.

* * * * *